United States Patent [19]

Diehl

[11] Patent Number: 5,005,925

[45] Date of Patent: Apr. 9, 1991

[54] COMBINATION TOY CHEST AND TABLE

[76] Inventor: Henry Diehl, 26 Old East Neck Rd., Melville, N.Y. 11747

[21] Appl. No.: 510,592

[22] Filed: Apr. 17, 1990

[51] Int. Cl.[5] ..... A47B 77/10

[52] U.S. Cl. ..... 312/282; 108/38; 108/94

[58] Field of Search ..... 312/282, 281, 317.2, 312/317.3, 326, 315, 316; 108/152, 38, 39, 33, 94, 95

[56] References Cited

U.S. PATENT DOCUMENTS

| | | | |
|---|---|---|---|
| 2,488,431 | 11/1949 | Parwell et al. | 312/293 |
| 2,515,112 | 12/1950 | Woody | 312/282 |
| 2,655,420 | 10/1953 | Hadley | 312/282 |
| 2,780,509 | 2/1957 | Geitman | 312/290 |
| 2,886,393 | 5/1959 | Tonning et al. | 312/228 |
| 2,988,413 | 6/1961 | Bergen | 312/282 |
| 3,164,431 | 1/1965 | Black | 312/282 |
| 3,221,890 | 12/1965 | Wassell | 312/305 |
| 3,999,822 | 12/1976 | Nagle | 312/317.2 |
| 4,054,338 | 10/1977 | Martin | 312/282 |

*Primary Examiner*—Kenneth J. Dorner
*Assistant Examiner*—Gerald A. Anderson
*Attorney, Agent, or Firm*—Collard, Roe & Galgano

[57] ABSTRACT

A combination toy chest and table has a top lid which serves as a desk top, and which is pivoted at one end to be movable between a closed position and an open position. In the closed position, the toy chest serves its normal function with the lid covering the toy chest. In its open position, the lid is displaced approximately 90° from the toy chest and is supported by preferably two legs to give it stability in this position. A person such as a child need only to place a chair next to the table for use at this point. A spring loaded locking mechanism is employed for locking the top in its closed position. In a further embodiment, the top lid for the toy chest extends beyond the width of the toy chest, so that it could also be used as a desk when the toy chest is in its closed position.

10 Claims, 2 Drawing Sheets

COMBINATION TOY CHEST AND TABLE

BACKGROUND OF THE INVENTION

1. Field of the Invention

The present invention relates to a combination toy chest and table, having a top lid which serves as a desk top, and which lid is pivoted at one end to be movable between a closed position and an open position.

2. The Prior Art

The Black U.S. Pat. No. 3,164,431 discloses a cabinet housing having a cabinet top which serves as both a closure for an upper compartment and as a table top for supporting articles for the convenience of a bed patient. The cabinet top is pivoted to move between an open and a closed position with respect to the cabinet housing. The Gleitsman U.S. Pat. No. 2,780,509, and the Tonning et al U.S. Pat. No. 2,886,393 each show pivotable cabinet tops. The Woody U.S. Pat. No. 2,535,112, the Parnell et al U.S. Pat. No. 2,488,431, the Wassell U.S. Pat. No. 3,221,890, and the Martin U.S. Pat. No. 4,054,338, show a variety of cabinets with movable tops.

SUMMARY OF THE INVENTION

It is an object of the present invention to provide a combination toy chest and table, having a top lid which serves as a desk top, and which table top lid is pivoted at one end to be movable between a closed position and an open position.

The above object is accomplished in accordance with the present invention by providing a combination toy chest and table comprising a housing having a closed bottom wall, sidewalls extending completely around said bottom wall and extending vertically upwardly therefrom and having an upper perimeter edge to create a hollow interior space within said housing and an open top portion; a table top movably and rotatably connected to said housing and movable between a closed position for covering the open top portion of said housing and an open position for uncovering the open top portion of said housing; said table top having an underside; and a leg attached to the underside of the table top for supporting said table top in the closed or open position.

BRIEF DESCRIPTION OF THE DRAWINGS

Other objects and features of the present invention will become apparent from the following detailed description considered in connection with the accompanying drawing which discloses one embodiment of the present invention. It should be understood, however, that the drawing is designed for the purpose of illustration only and not as definition of the liimits of the invention.

In the drawing wherein similar reference characters denote similar elements throughout the several views.

DETAILED DESCRIPTION OF THE PREFERRED EMBODIMENT

Figure 1:
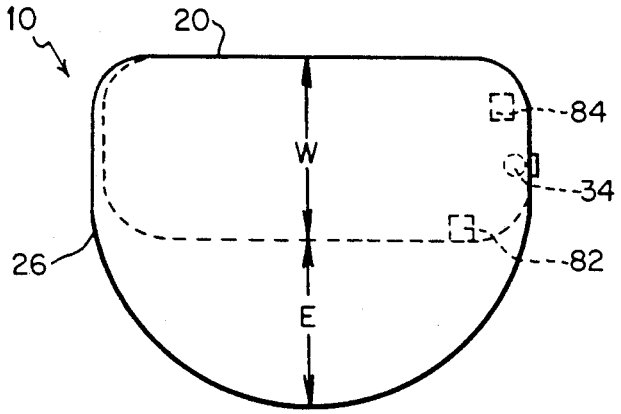
FIG. 1 shows a top view of the combination toy chest and table, with the table in the closed position.
Figure 7:
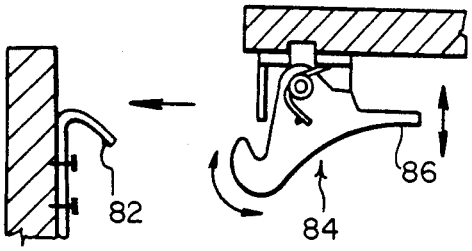
FIG. 7 shows a side section view of the second lock of the invention.
Figure 3:
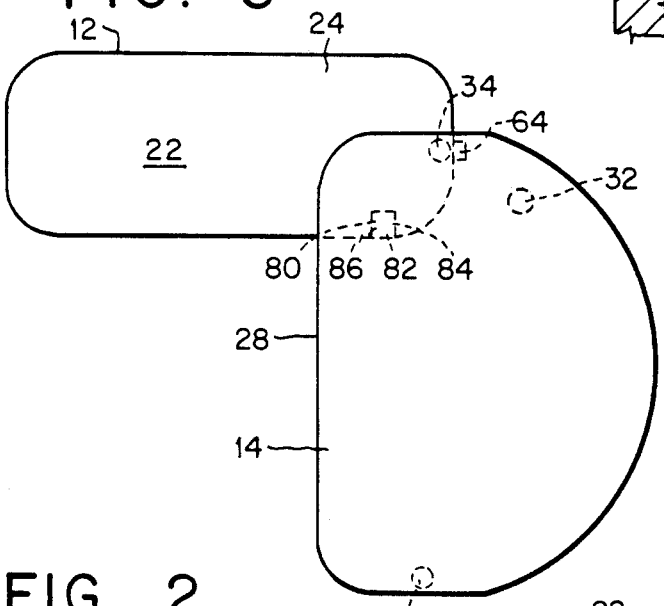
FIG. 3 shows a top view of the combination toy chest and table, with the table in the open position.
Figure 2:
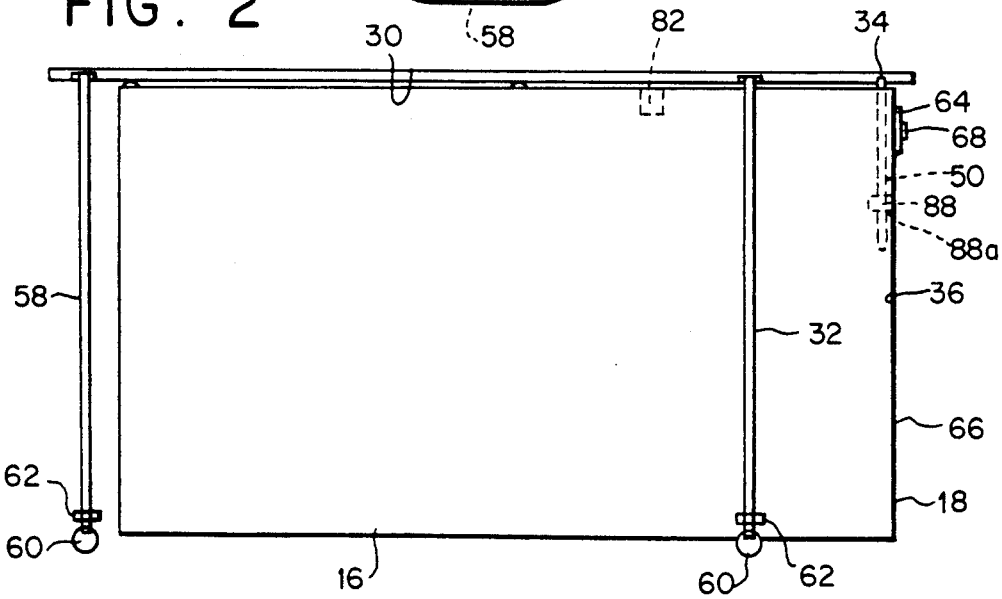
FIG. 2 shows a front view of the conbination toy chest and table of FIG. 1.

Turning now in detail to the drawings, FIG. 1 shows a top view of combination 10 toy chest 12 and table 14. This combination comprises the housing of the toy chest 12 which has a closed bottom wall 16 and has sidewalls 18 extending completely around the bottom wall, and extending vertically upward therefrom. The sidewalls of the housing create an upper perimeter edge 20 and thus, there is a hollow interior space 22 within the housing, which also has an open top portion 24. There is a table top 14 movably and rotatably connected to the housing and movable between a closed position 26 shown in FIG. 1, for covering the open top portion 24 of the housing. There is also an open position 28, as shown in FIG. 3, for uncovering the open top portion of the housing. The table top has an underside 30, as shown in FIG. 2. There is a leg 32 attached to the underside 30 of table top for supporting the table top 14 in both the open position or the closed position.

Figure 6:
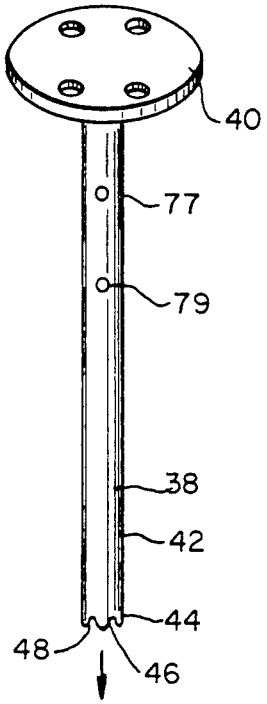
FIG. 6 shows an exploded view of the pivot hinge of the invention.

The combination also includes a pivot hinge 34 which is shown in FIGS. 1, 2, and 3, for movably connecting the table top 14 to the housing 12. The pivot hinge raising up the leg 32 during the rotatable movement of the table top. The pivot hinge 34 as shown in FIG. 2 is attached to the underside 30 of the table top and is simultaneously attached to the inside surface 36 of the sidewall 18 below the upper perimeter edge 20. The pivot hinge 34 comprises an inner cylindrical shaft 38, as shown in FIG. 6, having an upper end 40 and a lower end 42. The lower end of the inner shaft has a serrated edge 44 comprising four adjacent pointed sectors 46 separated by an adjacent spaced distance 48 between each sector. Each sector is separated 90° from every other sector, just as each spaced distance is separated by about 90° from every other spaced distance. Also there is an outer shaft 50 within the inner shaft 38 is rotatably located, and the outer shaft 50 has an upper end 52 and a lower end 54. The upper end 40 of the inner shaft 38 is connected to the underside 30 of the table top 14. The lower end 54 of the other shaft 50 has a projection means 56 for resting within the spaced distance 48 and for following the serrated edge 44 during the rotatable movement of the table top. This is such that as the table top rotates between the closed position, shown in FIG. 1, and the open position, as shown in FIG. 3, the projection means 56 is a nail or pin which follows the serrated edge from a spaced distance to an adjacent pointed sector and then over the pointed sector to an adjacent spaced distance. This caused the table top to rise up as the serrated edge moves relative to the stationary projection means from the spaced distance upwardly to a pointed sector and to move downwardly as the projection means moves down from the pointed sector to an adjacent spaced distance. Having the table top rise as it rotates enables the table leg to move easily over carpenting on the floor.

The leg 32 is attached to the table top 14 adjacent to the pivot hinge 34. There is also a second leg 58 attached to the underside 30 of the table top at a farther distance from the pivot hinge.

There is a roller 60 attached to the bottom of the leg 32 or the second leg 58. Also, there is a means 62 on the leg above the roller for adjusting the length of the leg or the second leg to compensate for variations in the floor level under the leg or second leg.

Figure 5:
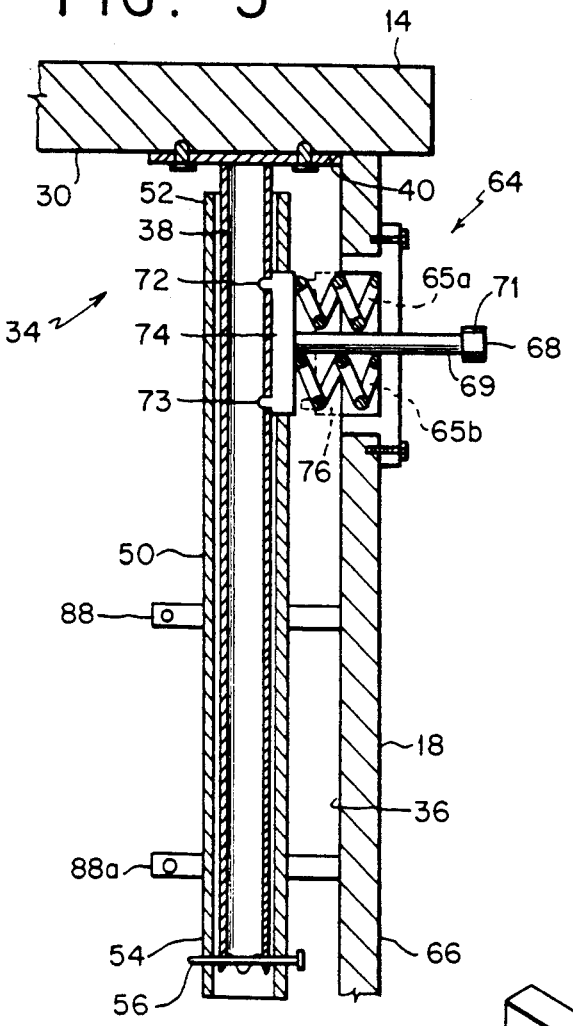
FIG. 5 shows a side section view of the lock for holding the pivot hinge.
Figure 4:
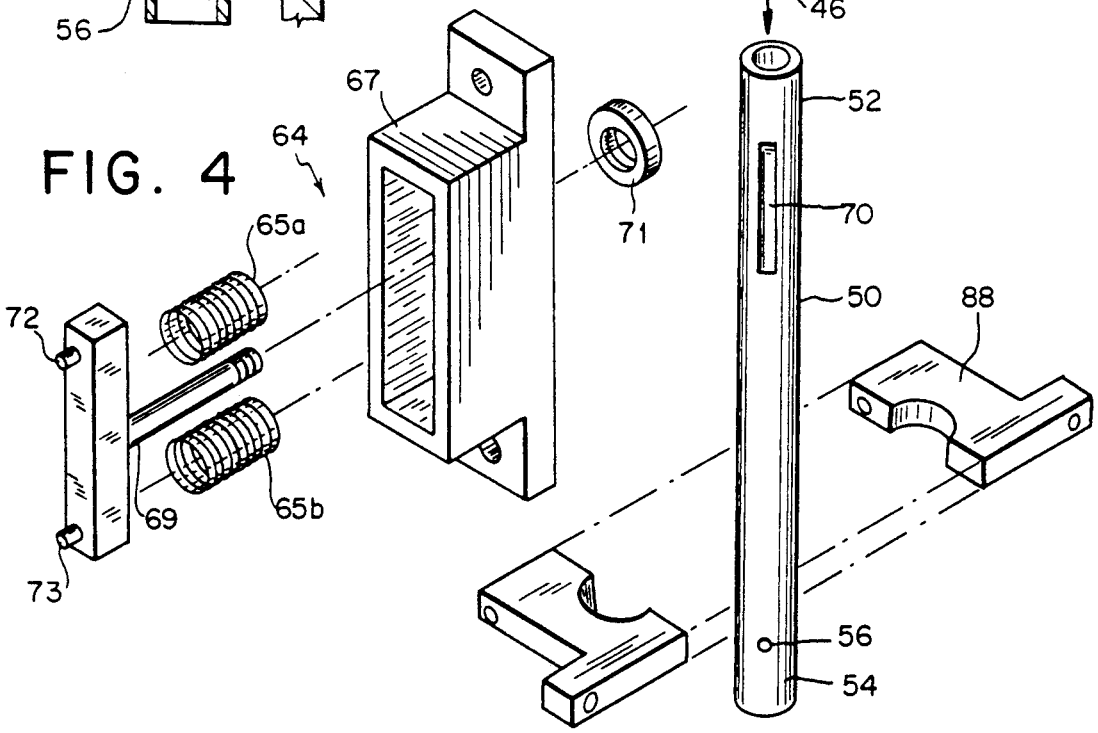
FIG. 4 shows an exploded perspective view of the lock for holding the pivot hinge.

A first lock 64 for holding immovable the pivot hinge 34 is to prevent movement of the table top 14 and to maintain the table top in the closed position. The first lock 64 is located on the outside 66 of the sidewall adjacent to the pivot hinge 34 and passing through the side wall to contact and control the pivot hinge. There is also a spring actuated lock release button 68, which is shown in FIGS. 2, 4, and 5, on the first lock for releasing the first lock to enable the pivot hinge to be movable to permit movement of the table top from the closed position to the open position. As shown in FIGS. 4 and 5, the first lock 64 for holding the pivot hinge 34 includes a vertical column shaped slot 70 in outer shaft 50, in which a first pin 72 and a second pin 73 are movable between an engaged position 74 within the slot 70 and a disengaged position 76 outside of this slot. The lock release button 68 is connected to the pins 72 and 73 to move the pin between the engaged position and the disengaged position. The pins 72 and 73 are shown in the engaged position 74 and can grasp the inner shaft 38 through holes 77 and 79 in shaft 38 to hold means 56 within a spaced distance and to engage the lock and to prevent rotatable movement of the table top. The pins 72 and 73 in the disengaged position 76 will release the pins 72 and 73 from holes 77 and 79 in shaft 38 to allow means 56 to move to a pointed sector and to permit rotatable movement of the table top. The first lock 64 includes a spring means 65*a* and 65*b* inside lock housing 67. The springs press against T-bar 69 which carries the pins 72 and 73. Lock 64 is operated by lock release button 71. Normally the springs press and bias the pin to the left into the engaged position to engage the inner shaft so as to prevent rotatable movement of the table top. In order to disengage the locks, the finger grip 71 is pulled outwardly to the right so as to compress the springs and to move pins 72 and 73 out of holes 77 and 79 of the inner shaft, so as to permit rotatable movement of the table top. The inner shaft can rotate freely until the holes appear again in the slot 70, where they can be engaged by the pins.

A second lock 80 for holding immovable the table top 14 prevents movement of the table top and maintains the table top in the open position shown in FIG. 3. The second lock 80 has two parts, with a first part 82 located on the inside of the sidewall 18 and with a second part 84 located on the underside of the table top. There is a clasp release 86 on the second lock for releasing the second lock to enable the table top to be movable, to permit movement of the table top from the open position to the closed position. The second lock would be utilizable when the table top has been rotated through about 90° from the closed to the open position of FIG. 3.

A C-clamp 88 or 88*a* on the inside surface 36 of the sidewall 18 is to hold the pivot hinge 34 in place on the sidewall inside surface. While two pins 72 and 73, or two springs 65*a* and 65*b*, or two clamps 88 or 88*a*, are shown as a preferred embodiment, only one of each is required.

As shown in FIG. 1, as a preferred embodiment, the table top extends a distance E beyond the width W of the housing 12. Thus, when the table top is in the closed position, the table top can be used as a desk because of this extended distance E. That embodiment is shown in FIG. 1. As shown in FIG. 3, the table top 14 in the open position there, can also be used as a desk with there being sufficient space between table legs 32 and 58 for a person to place a chair therebetween and to sit in that chair comfortably located between the two legs 32 and 58.

The toy chest and table can be made of plastic or wood, while the pivot hinge, the first lock, and the second lock can be made of metal.

An advantage to having the second lock 80 is to make certain that if a small child were to climb into, and to be playing within the toy chest 22, that the table top 14 cannot be rotated into the closed position of FIG. 1, from the open position of FIG. 3, without a supervising adult first releasing the second lock by release means 86. The location of the release means 86 is positioned in such a way that a child will have difficulty releasing the second lock 80, whereas a supervisory adult can easily release the second lock 80 after any child in the toy chest is removed therefrom before closing the table top 14.

The first locking mechanism 64 is spring loaded as a safety features to be biased against it being possible to open the toy chest table top, unless a supervisory adult pulls the lock release button 71, and holds this button pulled outwardly, in order to counteract the force of the spring which is pushing the pins 72 and 73 into the locked position. Only by pulling out the lock release button 71 and maintaining it pulled out, is it possible to turn the table top and open the toy chest to reveal the housing and storage area 22. This safety feature is based upon having this pull release type of lock which must be held at all times in order to open the combination toy chest table top, to prevent children from opening the toy chest without the presence of a supervisory adult.

While only a single embodiment of the present invention has been shown and described, it is to be understood that many changes and modifications may be made thereunto without departing from the spirit and scope of the invention as defined in the appended claims.

What is claimed is:

1. A combination toy chest and table comprising:

a housing having a closed bottom wall;

a sidewall extending completely around said bottom wall and extending vertically upwardly therefrom and having an upper perimeter edge to create a hollow interior space within said housing and an open top portion;

a table top having two opposite ends and an underside;

a leg attached to the underside of said table top at one end for supporting said table top; and a pivot hinge attached to the underside of said table top adjacent to the other end thereof for movably and rotatably connecting said table top to said sidewall so as to allow pivotable movement of said housing between a closed position for covering the open top portion of said housing and an open position for uncovering said open top portion of said housing, said pivot hinge raising up said leg during the rotatable movement thereof.

2. The combination according to claim 1, wherein said leg is attached to said table top adjacent to said pivot hinge.

3. The combination according to claim 2, further comprising a second leg attached to the underside of said table top at a far distance from said pivot hinge.

4. The combination according to claim 3, further comprising a roller attached to the bottom of said leg or said second leg; and means on said leg above said roller for adjusting the length of said leg or said second leg to compensate for variations in the floor level under said leg or said second leg.

5. The combination of claim 1, further comprising a C-clamp on the inside surface of said sidewall to hold said pivot hinge in place on said sidewall inside surface.

6. The combination of claim 1, wherein said table top extends beyond the width of said housing, and when the table top is in said closed position, said table top can be used as a desk.

7. A combination toy chest and table comprising:

a housing having a closed bottom wall;

a sidewall extending completely around said bottom wall and extending vertically upwardly therefrom and having an upper perimeter edge to create a hollow interior space within said housing and an open top portion;

a table top having two opposite ends and an underside;

a leg attached to the underside of said table top adjacent to one end for supporting said table top; and a pivot hinge for movably connecting said table top to said housing, said pivot hinge raising up said leg during the rotatable movement thereof; said pivot hinge being attached to said underside of said table top and attached to the inside surface of said sidewall below said upper perimeter edge; said pivot hinge including an inner shaft having an upper end and a lower end, said lower end of said inner shaft having a serrated edge comprising four adjacent pointed sectors separated by an adjacent spaced distance between each sector, said upper end of said inner shaft connected to the underside of said table top; an outer shaft within which said inner shaft is rotatably located, said outer shaft having an upper end having a vertical column shaped slot and a lower end; said lower end of said outer shaft having a stationary projection means for resting within said spaced distance and for following the serrated edge during the rotatable movement of said table top; and such that as said table top rotates between said closed position an said open position, said projection means follows said serrated edge from a spaced distance to an adjacent pointed sector and then to an adjacent spaced distance, causing said table top to rise up as said serrated edge moves relative to said projection means from a spaced distance upwardly to a pointed sector and to move downwardly as said serrated edge moves down from said pointed sector to said adjacent spaced distance.

8. A combination toy chest and table comprising:

a housing having a closed bottom wall;

a sidewall extending completely around said bottom wall and extending vertically upwardly therefrom and having an upper perimeter edge to create a hollow interior space within said housing and an open top portion;

a table top having two opposite ends and an underside;

a leg attached to the underside of said table top adjacent to one end for supporting said table top;

a pivot hinge for movably connecting said table top to said housing, said pivot hinge raising up said leg during the rotatable movement thereof; said pivot hinge attached to the underside of said table top and attached to the inside surface of said sidewall below said upper perimeter edge;

a first lock for holding immovable said pivot hinge to prevent movement of said table top and to maintain said table top in the closed position, said first lock located on the outside of said sidewall adjacent to said pivot hinge and passing through said sidewall to contact and control said pivot hinge; and a spring activated lock release button on said first lock for releasing said first lock to enable said pivot hinge to be movable to permit movement of said table top from said closed position to said open position.

9. The combination according to claim 8, further comprising a second lock for holding immovable said table top to prevent movement of said table top and to maintain said table top in the open position, said second lock having two lock parts with a first part located on the inside of said sidewall and with a second part located on the underside of said table top; and a clasp release on said second lock for releasing said second lock to enable said table top to be movable to permit movement of said table top from said open position to said closed position.

10. The combination of claim 8, wherein said first lock for holding said pivot hinge fits within the vertical column shaped slot in which a pin is movable between an engaged position and a disengaged position, within said slot, and said lock release button is connected to said pin to move said pin between said engaged position and said disengaged position;

said pin in said engaged position grasping said inner shaft to engage the lock to prevent rotatable movement of said table top, and said pin in said disengaged position releasing said inner shaft to permit rotatable movement of said table top; and a spring means for biasing the pin into the slot and further into the inner shaft to engage the lock so as to prevent rotatable movement of the table top.

* * * * *